United States Patent [19]

Mourgue et al.

[11] Patent Number: 4,664,049

[45] Date of Patent: May 12, 1987

[54] LIGHTWEIGHT, KNOCKDOWN, SPORT TRIMARAN

[76] Inventors: Pascal Mourgue, 12, rue des Minimes, 75003 Paris; Patrice Hardy, 10, rue Faidherbe, 75011 Paris, both of France

[21] Appl. No.: 756,174

[22] Filed: Jul. 18, 1985

[30] Foreign Application Priority Data

Jul. 19, 1984 [FR] France ..... 84 11454

[51] Int. Cl.[4] ..... B63H 9/04

[52] U.S. Cl. ..... 114/39; 114/61; 114/103

[58] Field of Search ..... 114/39, 61, 123, 102, 114/103, 288, 292; 441/40, 44–46, 50, 53

[56] References Cited

U.S. PATENT DOCUMENTS

| | | | |
|---|---|---|---|
| 2,585,599 | 2/1952 | Tchetchet | 114/61 |
| 2,781,735 | 2/1957 | Roberts | 114/61 |
| 3,871,316 | 3/1975 | Woodrich | 114/39 |
| 4,136,414 | 1/1979 | Popkin | 114/39 |
| 4,401,047 | 8/1983 | Auras | 114/39 |

FOREIGN PATENT DOCUMENTS

| | | | |
|---|---|---|---|
| 195022 | 3/1906 | Fed. Rep. of Germany | 114/123 |
| 1957736 | 9/1971 | Fed. Rep. of Germany . | |
| 2843674 | 2/1980 | Fed. Rep. of Germany . | |
| 3139259 | 4/1983 | Fed. Rep. of Germany . | |
| 1481194 | 5/1967 | France | 114/123 |
| 1555762 | 1/1969 | France | 114/123 |
| 61091 | 4/1983 | Japan | 114/103 |
| 920588 | 3/1963 | United Kingdom . | |

*Primary Examiner*—Joseph F. Peters, Jr.
*Assistant Examiner*—Stephen P. Avila
*Attorney, Agent, or Firm*—Charles E. Brown; Charles A. Brown

[57] ABSTRACT

A trimaran comprises a central hull, two side hulls disposed on the respective sides of the central hull, a connecting structure detachably connecting the side hulls to the central hull and a mast for at least one sail. The connecting structure comprises a retaining carrier when the trimaran is disassembled, for accommodating the central hull and the side hulls for transport e.g. on an automobile roof rock and/or storage. The connecting structure comprises two connecting arms, parallel ends of the connecting arms being detachably secured to the side hulls. At least one cross member rigidly connects the connecting arms together and a mount is fixed to each of the connecting arms and detachably secured to the central hull.

18 Claims, 11 Drawing Figures

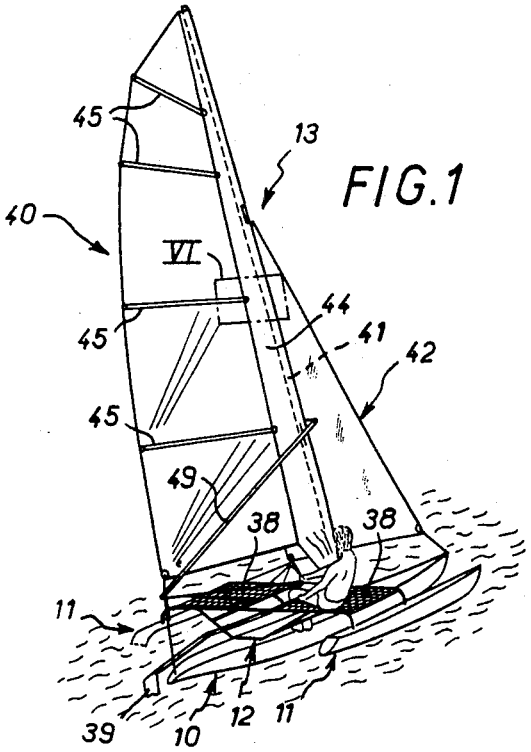
FIG.1
FIG.2
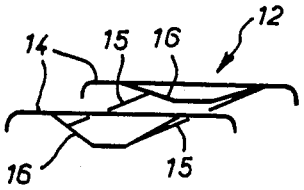
FIG.3
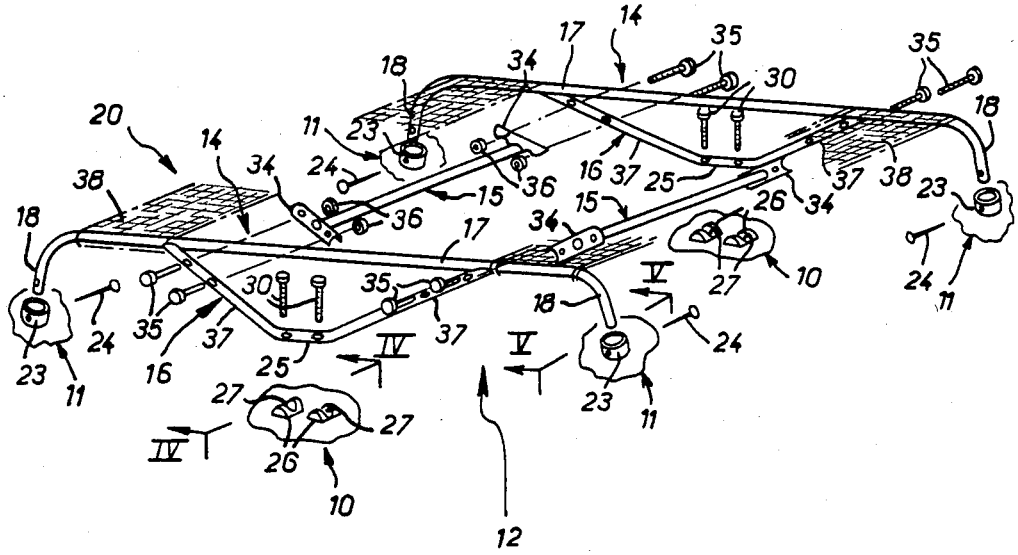

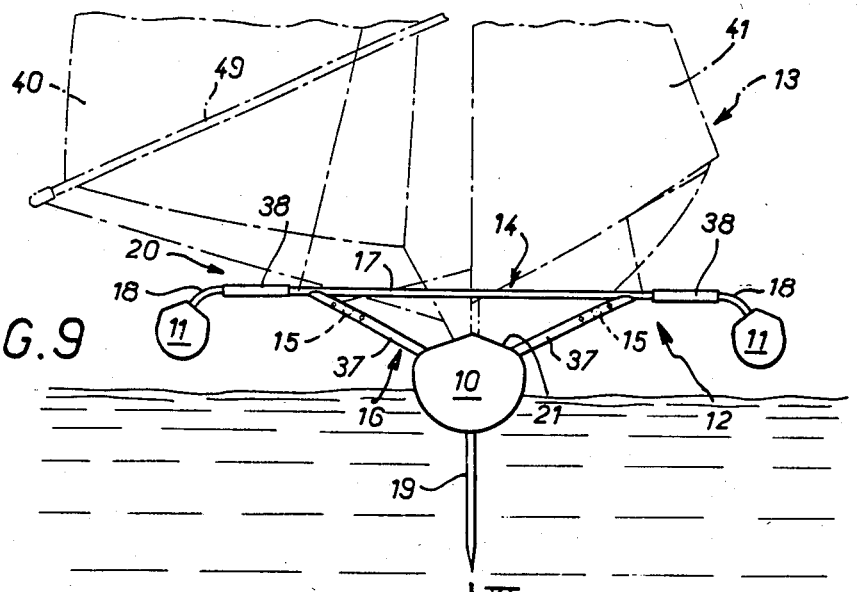
FIG.9
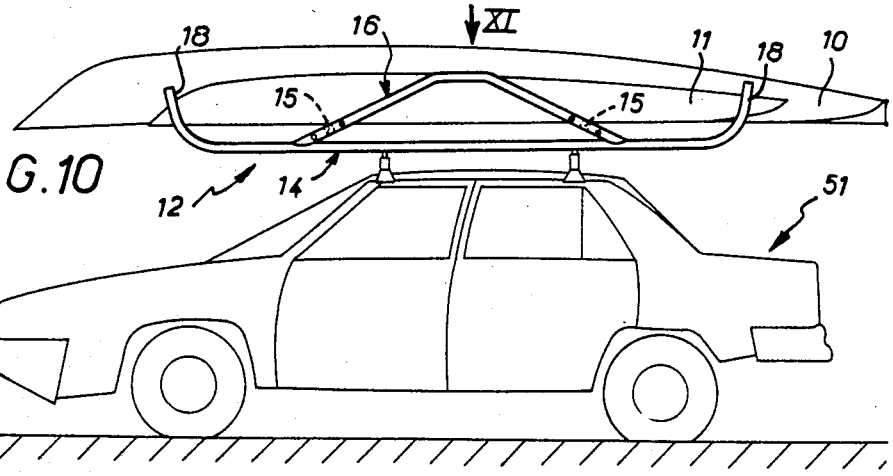
FIG.10
FIG.11
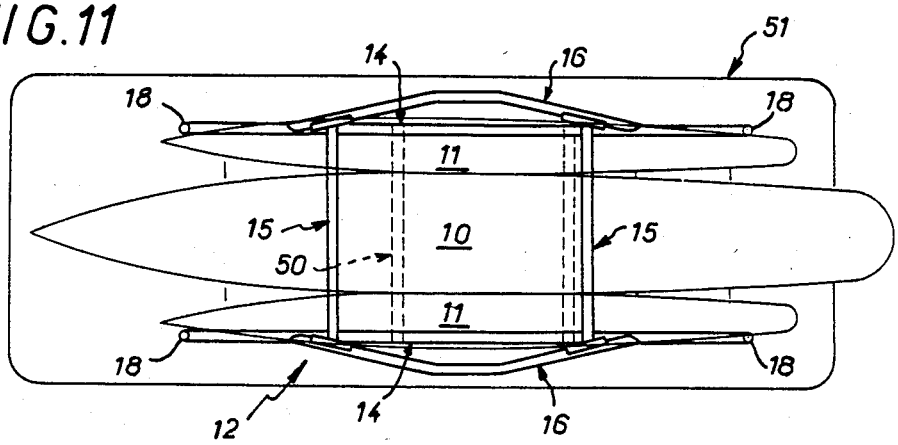

LIGHTWEIGHT, KNOCKDOWN, SPORT TRIMARAN

BACKGROUND OF THE INVENTION

The present invention relates generally to trimarans, i.e., sailboats, in practice of the flying dutchman type, comprising a central hull and two side hulls, and a connecting structure interconnecting the central hull and the two side hulls.

The invention is more particularly directed to such trimarans which are relatively light in weight and suitable for pleasure boating in coastal waters while requiring unquestionable athletic skills and physical efforts on the part of the user.

Experience has shown that the overall bulkiness of this type of sailboat and in general all flying dutchman type sailboats has been a limitation to their development. For example, numerous potential users such as those who have acquired experience through wind-surfing have given up on owning their own sailboat because of the constraints of transport and storage in the off-season, or dry docking, necessary for such a sailboat.

OBJECT AND SUMMARY OF THE INVENTION

A general object of the present invention is to provide a trimaran which due to its ease of transport and storage is particularly satisfactory for such a category of potential users.

According to the invention the trimaran comprises a central hull, two side hulls disposed on the respective sides of the central hull, a connecting structure detachably connecting the side hulls to the central hull, and a mast for at least one sail. The connecting structure comprises a retaining carrier when the trimaran is disassembled, for accommodating the central hull and the side hulls for transport and/or storage.

The transport of the trimaran by automobile is facilitated since it is notably not necessary to use any trailer. According to a feature of the invention, after disassembling the trimaran the connecting structure is turned upside down on a roof rack of conventional construction, the central hull and the side hulls are arranged thereon and the parts of the sailboat are then secured to the roof rack by conventional straps, the connecting structure comprising by itself the equivalent of retaining rails adapted to suitably maintain the hulls.

Likewise storage in the off-season is substantially which advantageously eliminates the need for using dry docks.

In practice the connecting structure of the trimaran preferably comprises two connecting arms, the ends of each of the connecting arms being detachably secured in parallel to the side hulls, at least one and in practice two cross members securing the connecting arms to each other, and two mounts which are fixed to the respective connecting arms and adapted to be detachably connected to the central hull.

The connecting structure is preferably of tubular construction and is particularly light in weight.

Preferably, each one of connecting arms is of inverted U-shaped configuration, including an intermediate, bight portion carrying the associated mount and two legs adapted to be connected to the side hulls, and the intermediate, bight portions of the connecting arms partake in the construction of the seating and extend substantially above the upper surface of the central hull.

This produces a dual advantage. First, on account of the difference in level thus provided between the seating for the user and the upper surface of the central hull on which he may rest his feet, he can operate the trimaran from a relatively confortable position. Secondly, being raised with respect to the central hull the connecting structure advantageously forms an opening for a wave to pass without striking the trimaran, defined under the connecting structure and between the central hull and the respective side hulls.

In addition to these advantages the trimaran according to the invention admits of simple and therefore economical construction, reduced-cost maintenance and may be used with one or two-man crews without extensive training. It has considerably navigational stability and is capable of performances, namely in respect to speed, comparable to present-day sailboats of the flying dutchman class.

BRIEF DESCRIPTION OF THE DRAWINGS

These and other features of the invention will become apparate from the description which follows, given by way of example, with reference to the accompanying drawings.

FIG. 1 is a perspective view of a trimaran embodying the present invention;

FIG. 2 is a perspective view of the connecting structure for the trimaran of FIG. 1, illustrated on its own;

FIG. 3 is an enlarged scale, exploded, perspective view of the connecting structure, illustrating anchoring points on the central and side hulls;

FIG. 9 is a front elevational view of the trimaran of FIG. 1 sailing in water;

FIG. 10 is a side elevational view illustrating the transport of the trimaran knocked down, on the roof of an automobile; and FIG. 11 is a top plan view corresponding to FIG. 10, taken in the direction of arrow XI in FIG. 10.

DESCRIPTION OF THE PREFERRED EMBODIMENT

Figure 4:
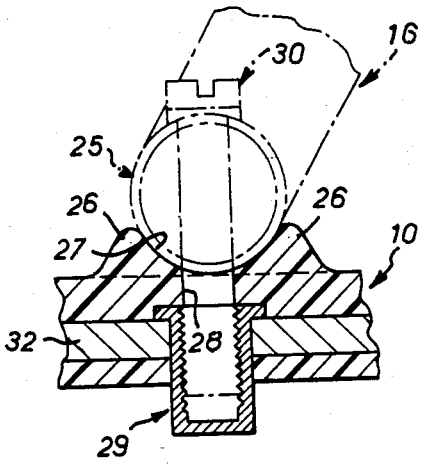
FIG. 4 is a still larger scale sectional view of the central hull taken along line IV—IV in FIG. 3.

As illustrated in the drawings the trimaran according to the invention comprises, as is conventional, a central hull 10, connecting structure 12 connecting the side hulls 11 to the central hull, and sails 13.

The trimaran will not be described in all its details herein. We will only concern ourselves with those parts necessary for understanding the invention.

Thus, for example with respect to the central hull 10, suffice it to say that according to conventional teachings, the central hull may be equipped with a retractable keel 19 and that it is capable of being molded from a suitable synthetic material, with discrete metal inserts or fixtures for the various fixing or anchoring points. Preferably, the central hull 10 is streamlined for permitting planing and fast tacking.

Likewise with respect to the side hulls 11, it will simply be indicated that they are preferably immersable to reduce the forces exerted on the connecting structure 12 and permit the trimaran to be righted easily in case it capsizes.

According to the invention the connecting structure 12 is detachable from the central hull 10 and the side hulls 11 and is adapted to form when it is turned over a cradle or carrier frame for retaining the central hull 10 and the side hulls 11 for transporting them on the roof of an automobile and/or for storage.

In the illustrated embodiment the connecting structure 12 comprises two connecting arms 14 having parallel ends adapted to be detachably secured to the side hulls 11, at least one cross member and in practice two cross members 15, for rigidly securing the connecting arms 14 to each other, and two mounts 16 which are respectively carried by the connecting arms 14 and adapted to be detachably fixed to the central hull 10.

The various components of the connecting structure 12 are preferably tubular members, and made of metal, for example, aluminum.

Each of the connecting arms 14 is of inverted U-shaped configuration, including a bight portion 17 to which is fixed the associated mount 16, and legs 18 for connecting it to the side hulls 11, FIG. 3.

As regards the mount 16, the bight portion 17 for such a connecting arm 14 which, as it will be brought out below, partakes in forming the seating 20, lies substantially above the upper surface 21 of the central hull 10, FIG. 9.

In practice the height of the mount 16 from the bight portion 17 of the connecting arm 14 is greater than that of the legs 18 of the connecting arms 17 so that overall the side hulls 11 lie at a height midway between the seating 20 and the central hull 10.

In practice the legs 18 of each of the connecting arms 14 are slightly divergeant or flared so that the side hulls 11 themselves are likewise slightly divergeant.

Figure 5:
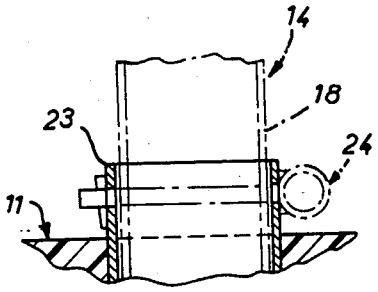
FIG. 5 is a similar fragmentary sectional view of one of the side hulls, taken along line V—V in FIG. 3.

Each of the side hulls 11 has two axially spaced bushes 23, each for receiving or fitting the corresponding end of the leg 18 of the associated connecting arm 14 and fixing it in position. Such a bush 23 preferably comprises a metal insert in the associated side hull 11 and for the sake of water-tightness it has a closed bottom. In practice the bush is defined by a section of tube closed off at one end and having an inner diameter complementary to that of the outer diameter of the respective leg 18 of the connecting arms 18. In any event such a bush 23 protrudes slightly beyond the surrounding surface of the associated side hull 11 to enable the insertion of a pin 14 for locking the connecting arm 14 in position as schematically illustrated in broken line in FIG. 5, or alternatively a wedge or cotter pin.

In the illustrated embodiment the mounts 16 are permanently fixed to the connecting arms 14, e.g., by welding. Further, the mounts 15 are flared with respect to each other, reckoned from the connecting arms 14, which increases correspondingly the breadth of the bearing support of the connecting structure 12 on the central hull 10. Further, in the illustrated embodiment each one of the mounts 16 has a generally trapezoidal configuration, with its short base 25 adjacent and fixed to the central hull 10.

The central hull 10 has at least two projecting fittings 26 for receiving a portion of each of the mounts 16, namely the smaller base 25 by which the mount bears on the central hull. In practice as shown in FIGS. 3 and 4, two pairs of fittings 26 are thus provided, spaced from each other. Each of the fittings 26 defines a sort of cradle 27 having a concave section complementary to that of the cross section of the small base 25 of the trapezoidal mount 16 for holding and locating the same. The pairs of fittings 26 associated with one of the mounts 16 are preferably spaced apart to enhance the wave impact resistance. At the bottom of each of the cradles 27 is a hole 28 in registry with a threaded insert 29 threadedly engageable with a bolt 30 for fixing the corresponding mount 16 to the central hull 10, as schematically illustrated in FIG. 4. In practice the threaded insert 29 which has a blind end is force-fitted in a reinforcing plate 32 which is itself an insert encapsulated in the corresponding upper wall 21 of the central hull 10.

In the illustrated embodiment the cross members 15 which lie substantially perpendicularly to the connecting arms 14 extend from one of the mounts 16 to the other. In other words the cross members 15 interconnect the connecting arms 14. Preferably, each one of the cross members 15 is detachably connected to the mounts 16. For example, as illustrated each cross member 15 comprises at each of its ends a concave section 34 fixed thereto, for example by welding, and extending generally transversely to the rest of the cross member. The cross member 15 may be fixed by nuts 36 and bolts 35 to the respective mounts through the concave sections 34. As illustrated two pairs of nuts 36 and bolts 35 are sufficient for fixing of each cross member 15 at each of its ends.

As will be noted, the cross members 15 extend under the deck or seating 20 and between the deck or seating 20 and the central hull 10.

Accordingly, if the deck or seating 20 is formed simply by two parallel canvas portions 38 stretched from one of the connecting arms 14 to the other, and at the ends thereof, the cross members 15 do not hinder the user when he sits on the canvas portion 38 and causes it to sag under his weight.

The resulting connecting structure 12 is very rigid and therefore very sturdy. The connecting structure 12 receives the necessary rigging of the trimaran. As the rigging is well known per se and does not concern the present invention, it need not be described in detail. The rigging includes a rudder 39 which may be lifted out of the water, FIG. 1.

Figure 8:
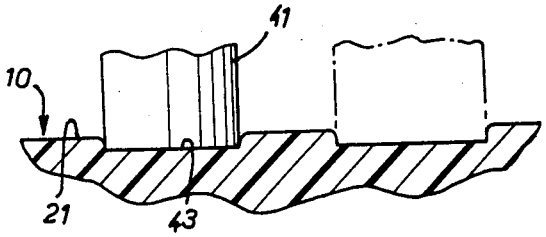
FIG. 8 is a partial axial sectional view through the central hull of the trimaran.

The sails 13 comprise a mainsail 40 with battens 45 which is received on a preferably two-part mast 41 and optionally a jib 42, as illustrated. The mast 41 which is suitably stayed or guyed is supported on the central hull 10 and the foot of the mast 41 is received in a shallow recess 43 formed as a depression in the upper surface 21 of the central hull 10. In practice, two recesses 43 are provided, spaced from each other on the upper side 21 of the central hull 10 along the longitudinal axis thereof. One of the recesses 43 is employed when a jib desired and the other when no such jib is used, FIG. 8.

Figure 6:
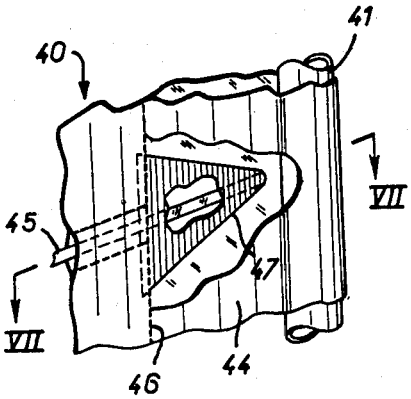
FIG. 6 is an enlarged scale view of the area enclosed within phantom line block VI, illustrating the mast and sail.
Figure 7:
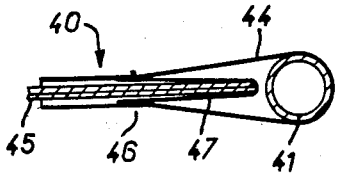
FIG. 7 is a partial sectional view through the sail and the mast, taken on line VII—VII in FIG. 6.

In the illustrated invention the mainsail 40 is provided with a sheath 44 which is adapted to be received on the mast 41. The sheath 44 which is relatively wide and triangular in configuration facilitates the flow of air as if the mast 41 had a substantially tapered cross section, see FIGS. 1, 6 and 7.

A wishbone boom 49 is, as illustrated, preferably associated with the mast 41.

Preferably, as illustrated, each of the battens 45 of the mainsail 40 does not end at the seam 46 between the sheath 44 and the actual mainsail 40, but rather it extends advantageously beyond the seam 46. Individual triangular pockets 47 are provided to restrain the ends of the battens 45 inside the sheath 44. Such an extention of the battens 45 of the mainsail 40 advantageously gives the mainsail a desirable hollow.

The trimaran embodying the invention has been found to be particularly fast, its configuration enabling it to be navigated in equilibrium on the central hull as illustrated in FIG. 9, which is one reason for its speed.

It is easily manouverable, highly responsive to the rudder, well-balanced, fast tacking, and takes waves well.

Further, the trimaran planes easily and remains so stabilized.

In case the trimaran capsizes it is easily righted.

From the foregoing it follows that in order to disconnect the connecting structure 12 from the central hull 10 and the side hulls 11, only a relatively small number of screws and pins need be removed, namely, in the illustrated embodiment, the four bolts 30 and an equal number of pins or wedges 24. The disassembly is therefore particularly fast and easy.

The connecting structure 12 thus removed may advantageously be used for the transport of the central hull 10 and the side hulls 11 and/or their storage. For example, for the transport of the hulls, the connecting structure 12 is simply placed upside down on the roof rack 50 of an automobile 51, as schematically illustrated in FIG. 10.

By means of the legs 18 of the connecting arms 14 and the mounts 16, the connecting structure 12 comprises a cradle or retaining carrier for the hulls 10 and 11 arranged side by side on the cross members. The mast which is in two parts may be taken apart and positioned on top of the central hull and/or the side hulls for transporting and/or storing the trimaran thus taken apart.

The usual elastic straps suffice for securing the disassembled components of the trimaran to the roof rack 50.

Of course the invention is not intended to be limited to the illustrated and described embodiments, but on the contrary covers all alternatives and variations within the scope of the appended claims.

What we claim is:

1. A trimaran comprising a central hull, two side hulls disposed on the respective sides of said central hull, a connecting structure detachably connecting said side hulls to said central hull, and a mast for at least one sail, said connecting structure comprising when the trimaran is disassembled, a cradle-like retaining carrier in an inverted position and also an angularly shifted position relative to said central hull for accommodating said central hull and said side hulls for transport and/or storage.

2. A trimaran according to claim 1, wherein said connecting structure comprises two connecting arms, parallel ends of each of said connecting arms being rigidly but detachably secured to said side hulls, at least one cross member for rigidly connecting said connecting arms together, and a mount fixed to each of said connecting arms, said mounts being rigidly but detachably secured to said central hull.

3. A trimaran according to claim 2, wherein each of said connecting arms is of inverted U-shaped configuration, comprising two legs and an intermediate bight portion, each of said mounts being fixed to the bight portion of the respective U-shaped connecting arm, and the two legs of each of said U-shaped connecting arms being connected to said side hulls, said bight portion supporting seating and extending substantially above the upper surface of said central hull.

4. A trimaran according to claim 3, wherein each of the side hulls comprises two bushes to fittingly receive the ends of said legs of said connecting arms, and means for locking said legs in position in said bushes. -

5. A trimaran according to claim 2, wherein each of the mounts is of trapezoidal configuration, the smaller base of the trapezoidal mount being adjacent said central hull.

6. A trimaran according to claim 2, wherein said mounts flare with respect to each other, from their respective connecting arms.

7. A trimaran according to claim 2, wherein said mounts are permanently fixed to the connecting arms.

8. A trimaran according to claim 2, further comprising pairs of projecting fittings on said central hull for receiving a portion of said mount and bearing the same.

9. A trimaran according to claim 2, wherein two cross members are provided substantially perpendicular to the connecting arms and interconnecting the same.

10. A trimaran according to claim 9, wherein each of said cross members is detachably fixed to said mounts, each of said cross members comprising at each end thereof a concave section adapted to receive and to be fixed to a portion of the associated mount.

11. A trimaran according to claim 1, wherein said central hull comprises at least one recess for receiving a foot of said mast, said mast carrying a mainsail having a sheath received on said mast, said sheath being substantially upwardly tapered triangular in elevation.

12. A trimaran according to claim 11, wherein said mainsail has battens and said sheath has pockets to accommodate terminal portions of said battens.

13. A trimaran according to claim 3, wherein each of said mounts is of trapezoidal configuration, and the smaller base of the trapezoidal mount being adjacent said central hull.

14. A trimaran according to claim 3, wherein said mounts flare with respect to each other, from their respective connecting arms.

15. A trimaran according to claim 3, wherein said mounts are permanently fixed to the connecting arms.

16. A trimaran according to claim 3, further comprising pairs of projecting fittings on said central hull for receiving a portion of said mount and bearing the same.

17. A trimaran according to claim 3, wherein two cross members are provided substantially perpendicular to the connecting arms and interconnecting the same.

18. A trimaran according to claim 17, wherein each of said cross members is detachably fixed to said mounts, each of said cross members comprising at each end thereof a concave section adapted to receive and to be fixed to a portion of the associated mount.

* * * * *